US008524350B2

(12) United States Patent
Lee

(10) Patent No.: US 8,524,350 B2
(45) Date of Patent: Sep. 3, 2013

(54) THRESHOLD MAT AND FLOOR PROTECTOR

(76) Inventor: Sharon D. Lee, Cumming, GA (US)

( * ) Notice: Subject to any disclaimer, the term of this patent is extended or adjusted under 35 U.S.C. 154(b) by 256 days.

(21) Appl. No.: 13/071,849

(22) Filed: Mar. 25, 2011

(65) Prior Publication Data

US 2012/0244308 A1 Sep. 27, 2012

(51) Int. Cl.
*B32B 3/02* (2006.01)

(52) U.S. Cl.
USPC ..... 428/80; 428/120

(58) Field of Classification Search
CPC ..... B32B 3/02
USPC ..... 428/80, 120, 157; 52/177, 180, 52/181
See application file for complete search history.

(56) References Cited

U.S. PATENT DOCUMENTS

| | | | | |
|---|---|---|---|---|
| 3,452,497 | A * | 7/1969 | Warp | 52/177 |
| 7,029,743 | B2 | 4/2006 | Robbins, III | |
| 7,955,679 | B2 * | 6/2011 | Duprez | 428/43 |
| 2005/0058803 | A1 * | 3/2005 | Bowden | 428/80 |

* cited by examiner

*Primary Examiner* — Alexander Thomas
(74) *Attorney, Agent, or Firm* — Brient Intellectual Property Law, LLC

(57) ABSTRACT

A mat is described which is suitable for placement over the threshold of an opening for protecting the threshold and nearby floor or other surface from excessive wear caused by pets or foot traffic. The perimeter edge of the mat in one embodiment includes a cutout or contour that is sized and shaped to at least partially engage the side post or jamb near the opening. One or both ends of the mat may include a contour that is shaped to engage the side jamb. The contour in another embodiment includes a slot that at least partially engages the wall near the opening. Engagement between the contoured edge of the mat and the side post or wall helps resist unintended movement of the mat when in place. The mat may also include downward protrusions for engaging with the floor or floor covering.

20 Claims, 8 Drawing Sheets

THRESHOLD MAT AND FLOOR PROTECTOR

BACKGROUND

The carpet or other flooring material around the threshold of a doorway or other opening typically endures substantial wear and tear, from pedestrian traffic and pets, for example. House pets such as cats and dogs, for example, may scratch the floor near an entry door. The floor area near the latch end of a door or gate may be the focus of a pet's scratching and therefore endure excessive wear and tear, often resulting in damage to the floor and requiring expensive and time-consuming repairs.

Traditional door mats provide limited protection for the carpet or other floor near a doorway because, for example, the edge of the mat can be easily raised or curled by foot traffic or the scratching activity of pets. If the edge of a door mat lies near the latch end of a door where a dog or cat might be naturally inclined to scratch at the floor, the door mat can be easily lifted, exposing the carpet to damage. Also, door mats often move or slide under normal use, such as when the door opens or closes.

Thus, there is an unsatisfied need in the art for greater protection and stability than is currently available from traditional door mats or other inadequate coverings.

SUMMARY OF VARIOUS EMBODIMENTS

A mat for covering part of a threshold of an opening and part of a floor near the threshold, in one embodiment, may include a substantially planar mat body with upper and lower surfaces. The opening may be partly defined by a substantially vertical first side jamb and a substantially opposing second side jamb. Each of the first and second side jambs may have a substantially planar face. The mat body may be substantially rectangular, having a first edge sized and shaped to at least partially engage the first side jamb and a second edge sized and shaped to at least partially engage the second side jamb. The mat body may be sized in length according to the threshold such that the mat covers substantially all of the threshold.

If the first side jamb includes a first non-planar feature, then the first edge may define a first cutout that is sized and shaped to at least partially match the first non-planar feature. Similarly, if the second side jamb includes a second non-planar feature, then the second edge may define a second cutout sized and shaped to at least partially match the second non-planar feature. In this configuration, the mat body with the first and second cutouts may be described as substantially H-shaped.

Where the opening is partly defined by a wall adjacent the opening, at least one of the first and second cutouts at least partially engages the wall. Further, the mat may include one or more protrusions extending downwardly from at least a portion of the lower surface for engagement with the floor. The protrusions may include a substantially planar adhesive layer. The protrusions may include an array of pegs, an array of projections arranged at an angle with respect to each nearest projection, or a series of ridges and grooves disposed alternately to form a corrugation. The protrusions may include a rim disposed near an edge of the mat body. The mat body may be made of material that is substantially transparent, substantially opaque, imbued with one or more colors, or imbued with a graphic image at least partially visible through the upper surface. A first portion of the mat body may have a first thickness and a second portion of the mat body near at least a portion of its edge may have a second thickness at least partially thinner than the first thickness, such that the difference between the thicknesses defines a taper.

In another embodiment, a mat for covering part of a threshold of an opening and part of a floor near the threshold may include a substantially planar mat body with upper and lower surfaces. The opening may be partly defined by a substantially vertical first side jamb and a substantially opposing second side jamb. The mat body may define a perimeter edge having a first contour sized and shaped to at least partially engage the first side jamb and a second contour sized and shaped to at least partially engage the second side jamb. The mat body may also have one or more protrusions extending downwardly from at least a portion of the lower surface for engagement with the floor. The mat body may be sized in length according to the threshold such that the mat covers substantially all of the threshold. The mat body may be sized in width such that the mat covers part of the floor on only one side of the threshold. Where the opening is partly defined by a wall adjacent the opening, at least one of the first and second contours at least partially engages the wall.

In another embodiment, a mat for covering part of a threshold of an opening and part of a floor near the threshold may include a substantially planar mat body with upper and lower surfaces. The opening may be partly defined by a substantially vertical first side post. The mat body may define a perimeter edge having a first contour sized and shaped to at least partially engage the first side post. If the first side post has a substantially planar face, then the first contour may include a substantially linear edge for engaging at least a portion of the substantially planar face. Where the opening is further partly defined by a second side post substantially opposing the first side post, the perimeter edge may have a second contour sized and shaped to at least partially engage the second side post. In this configuration, the mat body with the first and second contours may be described as substantially H-shaped. The mat body may be sized in width such that the mat covers part of the floor on only one side of the threshold. Where the opening is partly defined by a wall adjacent the opening, at least the first contour at least partially engages the wall. The first contour may include a slot that is sized and shaped to at least partially engage the wall such that, when so engaged, the first contour and the slot resists movement of the mat body. The mat may include one or more protrusions extending downwardly from at least a portion of the lower surface for engagement with the floor.

BRIEF DESCRIPTION OF THE DRAWINGS

Figure 1A:
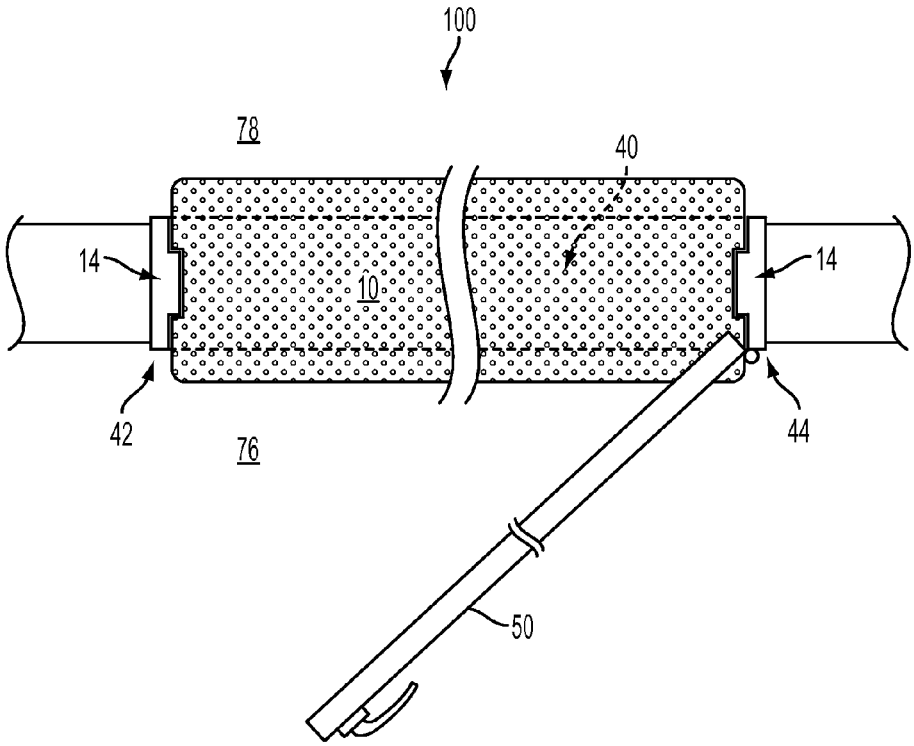

Having thus described various embodiments in general terms, reference will now be made to the accompanying drawings, which are not necessarily drawn to scale, and wherein:

FIG. 1A is a plan view of a mat selectively covering the threshold of a doorway, and part of the floors on both sides of the threshold, according to various embodiments.

Figure 1B:
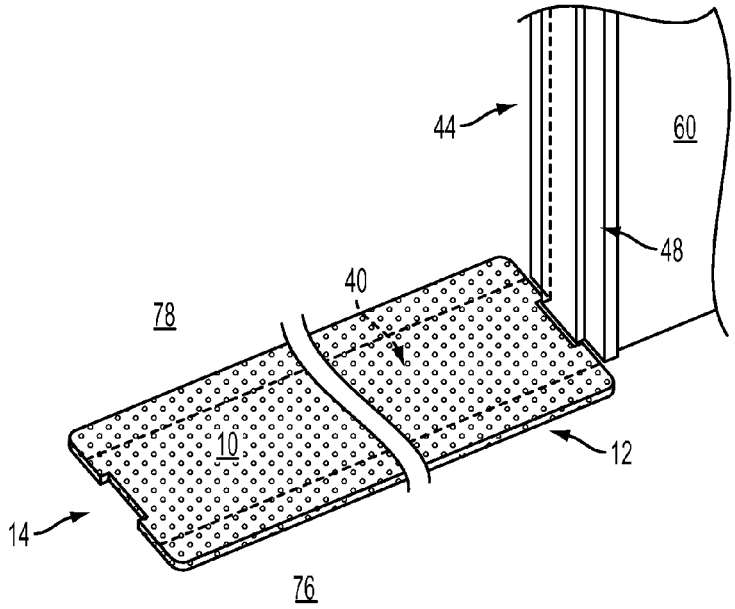

FIG. 1B is a perspective view of the mat of FIG. 1A, depicting one side jamb of the doorway.

Figure 2:
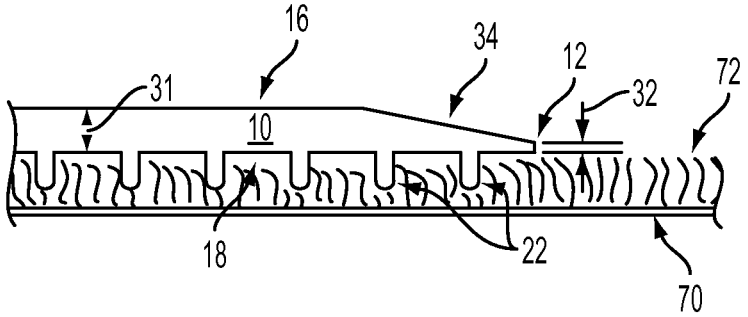

FIG. 2 is a cross-sectional view of a mat, according to various embodiments.

Figure 3:
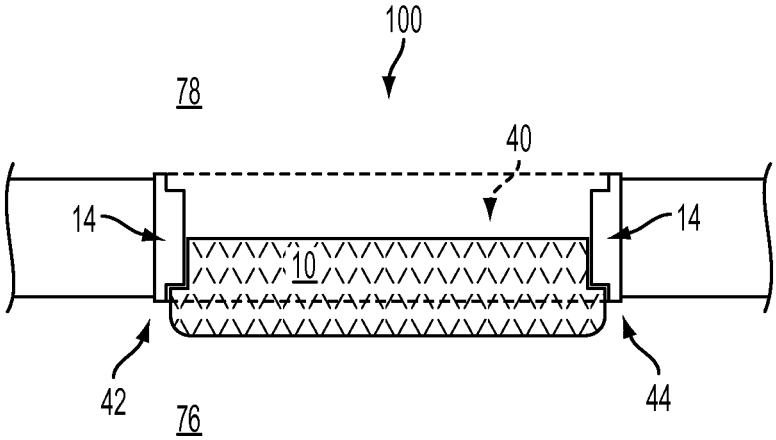

FIG. 3 is a plan view of a mat selectively covering part of a threshold and part of a floor, according to various embodiments.

Figure 4:
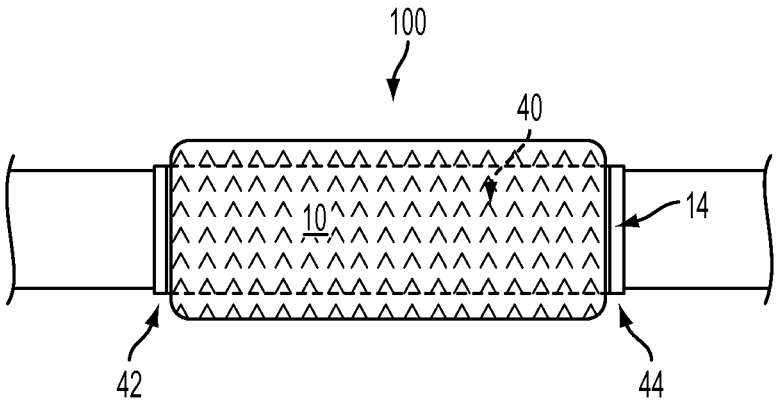

FIG. 4 is a plan view of a mat selectively covering a threshold and part of the floors on both sides of the threshold, according to various embodiments.

Figure 5:
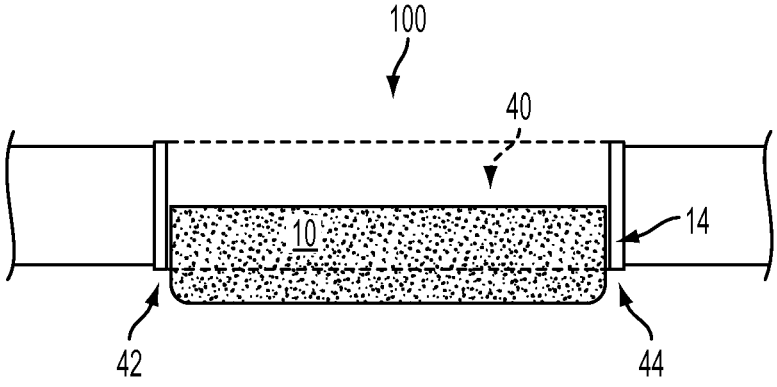

FIG. 5 is a plan view of a mat selectively covering part of a threshold and part of a floor, according to various embodiments.

Figure 6:
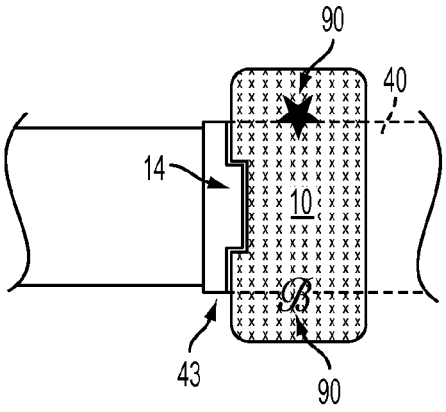

FIG. 6 is a plan view of a mat engaged with a side jamb and selectively covering part of a threshold, according to various embodiments.

Figure 7:
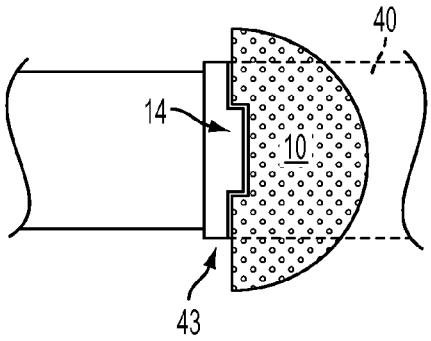

FIG. 7 is a plan view of a mat engaged with a side jamb and selectively covering part of a threshold, according to various embodiments.

Figure 8:
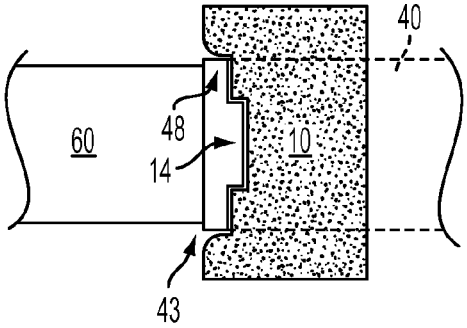

FIG. 8 is a plan view of a mat engaged with a side jamb and a molding, and selectively covering part of a threshold, according to various embodiments.

Figure 9C:
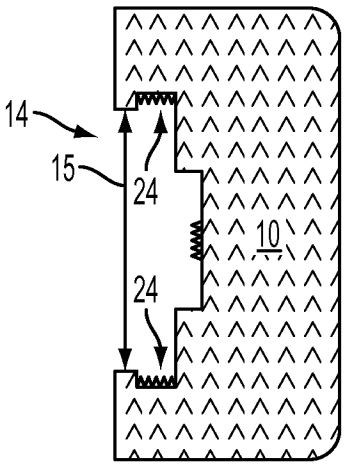
Figure 9B:
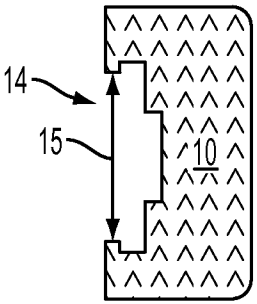
Figure 9A:
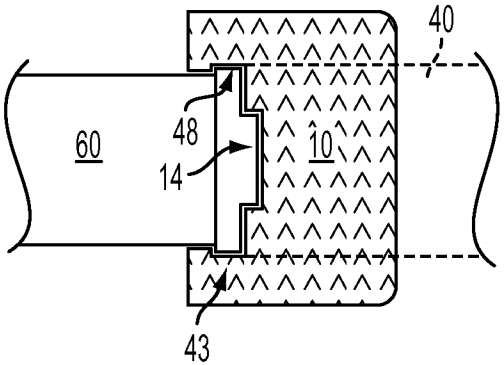

FIG. 9A is a plan view of a mat engaged with a side jamb, a molding, and a wall, the mat selectively covering part of a threshold, according to various embodiments.

FIG. 9B is a plan view of the mat of FIG. 9A.

FIG. 9C is a plan view of a mat having a contour that includes a slot, the mat also including lateral protrusions extending outwardly, according to various embodiments.

Figure 10B:
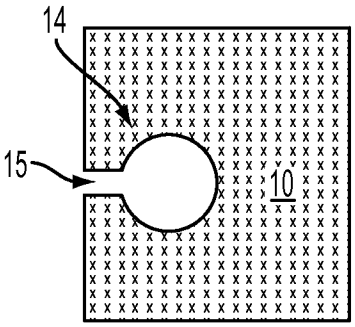
Figure 10A:
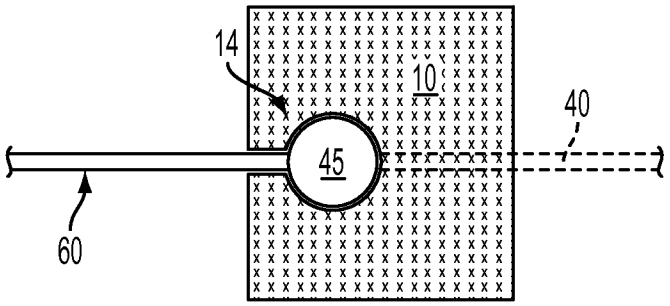

FIG. 10A is a plan view of a mat engaged with a side post and a fence or wall, the mat selectively covering part of a threshold, according to various embodiments.

FIG. 10B is a plan view of the mat of FIG. 10A.

Figure 11:
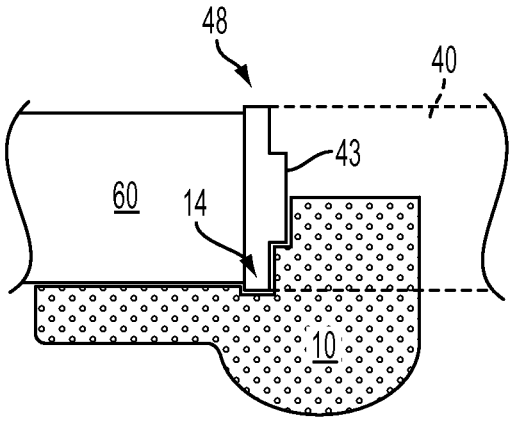

FIG. 11 is a plan view of a mat engaged with a side jamb, a molding, and a wall, the mat selectively covering part of a threshold, according to various embodiments.

Figure 12:
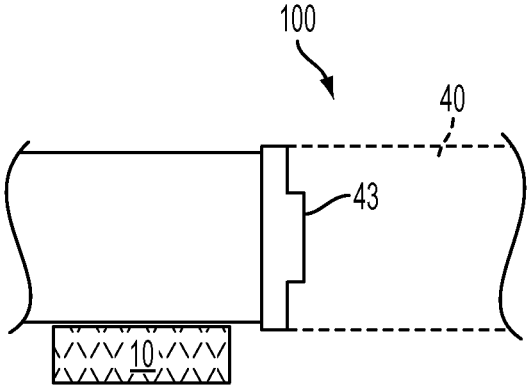

FIG. 12 is a plan view of a mat engaged with a wall, according to various embodiments.

DETAILED DESCRIPTION

Various embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

FIG. 1A is a plan view of a mat 10 according to an embodiment of the invention. The mat 10 shown in FIG. 1A is selectively covering part of the sill or threshold 40 of a doorway or other opening 100. A threshold 40 may include the area or region along the base of a door frame, window frame, gate, or other passageway between two spaces. A threshold 40 is not necessarily defined by a physical element or structure, such as a timber or stone. A threshold 40 is not necessarily part of a frame or other supporting structure.

The opening 100 shown in FIG. 1A includes a frame for a door 50 mounted on hinges. The frame may be described as having a pair of substantially vertical and opposing side posts or jambs such as the hinge-side jamb 44 and the latch-side jamb 42 shown in FIG. 1A, and a header jamb or lintel joining the upper ends of the side jambs. The frame may or may not include a substantially horizontal threshold 40 or door sill joining the lower ends of the side jambs.

The mat 10 may be used for any kind of opening 100. A side post or jamb may include an upright post, column, standard door jamb, or other substantially vertical member near an opening. A jamb is not necessarily part of a frame or other structure around an opening. A jamb may be a simple pole or a post. A jamb may include several distinct elements; for example, a face, a stop, a casing, and a decorative molding. A jamb may have a substantially planar face, or it may include one or more non-planar features.

As shown in FIG. 1B, the mat 10 may include a perimeter edge 12 having one or more cutouts or contours 14 that are sized and shaped to at least partially engage a side post or jamb near the opening 100. The contour 14 may be sized and shaped to nearly match the size and shape of a side post or jamb. The mat 10 may be formed to include a desired contour 14. Alternatively, the contour 14 may be formed by cutting a mat 10 into a desired shape. In this aspect, the body of a mat 10 may be formed in a beginning overall shape (rectangular, for example), and the addition of cutouts or contours 14 may change the overall shape of the mat 10. For example, two cutouts or contours 14 cut into opposing ends may create a mat 10 that is substantially H-shaped.

The mat 10, as shown in FIG. 1A, may include a contour 14 on each end for engagement with the side jambs 42, 44 of a door frame. As shown in a perspective view, in FIG. 1B, the contour 14 at the right end of the mat 10 at least partially engages with the hinge-side jamb 44. When the mat 10 is in place, the engagement between the contour 14 and the side post or jamb 44 may help resist unintended movement of the mat 10. When present, a closed door 50 may also help resist unintended movement of the mat 10.

The spaces near the opening 100 may include a floor and a floor covering. For example, the space nearer the viewer may include a first or nearby floor 76, as shown in FIG. 1A and FIG. 1B. The space on the other side of the opening 100 may include a second or distant floor 78. The spaces may be separated by a wall 60, as shown in FIG. 1B. The mat 10 shown in FIG. 1A and FIG. 1B covers part of the threshold 40 and part of both the nearby floor 76 and distant floor 78. As described herein, the mat 10 may be placed so that it covers any of a variety of different areas near an opening 100 or wherever floor protection is desired.

The mat 10 of particular embodiments may be used with any of a variety of standard door frames, which may include standard door sills, side jambs, casings, doorstops, moldings, and other features having a standard size. As shown and described herein, however, the mat 10 may also be used with any of a variety of non-standard or irregular openings, including those with no door.

FIG. 2 is a cross-sectional view of a mat 10 according to an embodiment of the invention. As shown, the mat 10 may have a substantially planar upper surface 16 and a lower surface 18 substantially parallel to the upper surface. In one embodiment, the lower surface 18 may include one or more protrusions 22 extending downwardly and sized and shaped to engage the floor 70, which may be covered with a carpet 72, as shown, or any other type of floor covering. When the mat 10 is in place, the protrusions 22 may engage the floor 70 and/or the floor covering such that the protrusions 22 may help resist unintended movement of the mat 10. In this aspect, the protrusions 22 may have any size and shape that at least partially engages with the floor and performs the function of resisting unintended movement of the mat 10. The downward protrusions 22 may take the form of a substantially planar adhesive layer, one or more ridges or downward-facing rim elements near the perimeter edge 12, a series of ridges and grooves, an array of regularly distributed pegs or knobs, or any combination of these elements. Protrusions 22 of different sizes and shapes may be used in order to sufficiently engage the type of floor or floor covering, including bare ground, which exists in the area to be covered.

In one embodiment, the upper surface 16 of the mat 10 may include one or more protrusions extending upwardly, which may take the form of a series of pegs, knobs, ridges, or the like, in order to provide a rough or textured upper surface 16. In this aspect, the rough texture of the upper surface 16 may dissuade animals, such as dogs and cats, from scratching at the upper surface 16 of the mat 10.

The mat body or mat 10 may be made of any of a variety of suitable materials. For example, the mat 10 may be made of a material having a weight that may help resist unintended movement of the mat 10 once in place. The opacity of the material may range from nearly transparent to opaque. Also, the material may be imbued with one or more colors or with graphic images, like the ones depicted in FIG. 6. A portion of the mat 10 may have a first thickness 31, as shown in FIG. 2. In one embodiment, the first thickness 31 may be sized to permit operation of a door or gate or other component near the opening.

In one embodiment, another portion of the mat 10 may have a second thickness 32 near the perimeter edge 12, as shown in FIG. 2. The second thickness 32 may be thinner than the first thickness 31, as shown. The difference between the first thickness 31 and the second thickness 32 defines a taper 34 which may extend around all or part of the perimeter edge 12 of the mat 10. Also, the second thickness may be sufficiently thin to allow manual trimming of the perimeter edge 12 with scissors or other cutting tool, thereby allowing the user to cut a contour 14 that fits a non-standard or otherwise irregular side post or jamb. In this aspect, the user may create a custom contour 14, tailored to fit the shapes and features of any opening.

In one embodiment, a portion of the mat 10 may have a third thickness (not shown), which may be thinner than both the first thickness 31 and the second thickness 32. The portion of the mat 10 having a third thickness may be sufficiently thin so that the perimeter edge 12 in this region is flexible or elastic. Part of this elastic region may or may not lie near or within a contour 14. In use, this region may be sufficiently elastic to allow the mat 10 to be placed against a side post or jamb which has an irregular shape. In this aspect, the mat 10 may engage a side post or jamb without including a contour 14 and/or without precisely matching the size and shape of the side post or jamb. Also, the elastic nature of this region may help resist unintended movement of the mat 10 once in place.

As shown in the various figures and described herein, the mat 10 may have any of a variety of shapes and sizes. The mat 10 may be sized and shaped to span nearly the entire opening 100 or only part of it. Similarly, the mat 10 may be sized and shaped to cover nearly the entire threshold 40 or only part of it. The mat 10 may be sized and shaped to engage only one side post or jamb, or with both. Also, the mat 10 may be sized and shaped to cover part of the floor on one or both sides of the opening 100. The size of the mat 10 may range from very small relative to the opening 100 or very large, depending on the amount of coverage or protection desired. In this aspect, the mat 10 of particular embodiments may be used for selectively covering any portion of the area near an opening.

As shown in FIG. 1A and FIG. 4, the mat 10 may be sized and shaped to span almost all of the opening 100, cover substantially all of the threshold 40, and cover part of the floor on both sides of the opening 100. As shown in FIG. 3 and FIG. 5, the mat 10 may be sized and shaped to span part of the threshold 40 and part of the floor on only one side of the opening 100. As shown in FIGS. 6 through 11, the mat 10 may be sized and shaped to engage only one of the side posts or jambs, and/or part of the threshold 40, and/or part of floor on one or both sides of the opening 100. In one embodiment, shown in FIG. 12, the mat 10 may cover a portion of the floor near an opening 100 while not covering any part of the threshold 40.

As shown in FIG. 3, the mat 10 in one embodiment may be sized and shaped to cover part of the threshold 40 and part of the floor on one side of the opening 100. In this view, the mat 10 may be placed to cover part of the floor on the interior of a structure; for example, over the floor inside an entry door of a home where pets might be expected to focus their scratching activity.

The mat 10 in various embodiments may be any of a variety of shapes and sizes suitable for a given opening 100 or intended use. FIG. 11 shows a mat 10 that includes a combination of shapes. Also, as shown in the various figures and described herein, any corner or other portion of the perimeter edge 12 of the mat 10 may be square or rounded. Any rounded corner may be sharply rounded (using a curve having a relatively small radius) or broadly curved (using a relatively large radius).

As described herein, the contour 14 may have any of a variety of shapes and sizes adapted to engage a side post or jamb having any shape. The jambs 42, 44 shown in FIG. 4 have a substantially planar face and, correspondingly, the contour 14 has a substantially linear edge. In this aspect, the contour 14 has been sized and shaped to at least partially engage the jambs 42, 44. The mat 10 may be sized in length to nearly match the size of the opening 100. In this embodiment, when the mat 10 is in place, the engagement between the contours 14 and the side jambs 42, 44 may help resist unintended movement of the mat 10. FIG. 5 shows a similar mat 10 that only covers a portion of the threshold 40.

As shown in FIG. 6, the mat 10 may include a contour 14 that is sized and shaped to engage one jamb 43. The jamb 43 may or may not have an opposing jamb on the other side of the opening. As shown, the mat 10 may cover only a portion of the threshold 40. The mat 10 may include one or more graphic images 90. FIG. 7 shows a mat 10 having a different shape, for a single jamb 43 that covers a portion of the threshold 40.

The mat 10 depicted in FIG. 8 may include a contour 14 that engages with more of the jamb 43 than the mat shown in FIG. 6 and FIG. 7. As shown in FIG. 8, the jamb 43 may include a door molding 48 (also shown in FIG. 1B) which, in this example, may extend beyond the surface of the wall 60. The mat 10, as shown, may cover only a portion of the threshold 40. In this embodiment, when the mat 10 is in place, the engagement between the contour 14 and the door molding 48 may help resist unintended movement of the mat 10.

The mat 10 shown in FIG. 9A may include a contour 14 that engages with still more of the side elements than the mat shown in FIG. 8. As shown in FIG. 9A, the contour 14 at least partially engages with both part of the jamb 43 (which includes a door molding 48) and part of the wall 60. The mat 10, as shown, may cover only a portion of the threshold 40. In this embodiment, when the mat 10 is in place, the engagement between the contour 14 and the door molding 48 may help resist unintended movement of the mat 10. FIG. 9B shows the mat 10 alone. The portion of the contour 14 that is sized and shaped to engage part of the wall 60 may be referred to as a slot 15, as shown in FIG. 9B. The slot 15, as shown, may be almost as wide as the contour 14 whereas, in other embodiments, the slot 15 may be narrower. In this aspect, the slot 15 is not necessarily a narrow opening.

As shown in FIG. 9C, the mat 10 in one embodiment may include a contour 14 with a slot 15 and one or more lateral protrusions 24 extending outwardly. The lateral protrusions 24 may extend from the edge of the mat 10 or any portion of the contour 14, including the slot 15. The lateral protrusions 24 may be sized and shaped to engage part of a jamb, a door molding, a wall, and any other side element near an opening. The lateral protrusions 24 may be flexible or substantially rigid. The lateral protrusions 24 may be shaped like gear teeth, knobs, pegs, ridges, corrugations, or the like. In this embodiment, when the mat 10 is in place, the engagement between the lateral protrusions 24 and the side elements, such as a jamb, may help resist unintended movement of the mat 10. Any of the embodiments shown or disclosed herein may include lateral protrusions 24.

The mat 10 in one embodiment may be used with a side jamb having any shape, such as the substantially cylindrical side post 45 shown in FIG. 10A. In this example, the post 45 acts like the door jamb depicted in the other figures. The mat 10, as shown, may include a contour 14 that at least partially engages with part of the post 45 and part of the fence or wall 60. A wall may include a fence, barrier, partition, border, or boundary, either inside a structure or outside. The mat 10 may cover only a portion of the threshold 40. In this embodiment, when the mat 10 is in place, the engagement between the contour 14 and part of the post 45 and/or the wall 60 may help resist unintended movement of the mat 10. FIG. 10B shows the mat 10 alone. The portion of the contour 14 that is sized and shaped to engage part of the wall 60 may be referred to as a slot 15, as shown in FIG. 10B. The slot 15, as shown, may be somewhat narrower than the contour 14.

The slot 15 does not necessarily engage a wall 60 or fence. For example, if the structure depicted in FIG. 10A included only a post 45 (without a wall 60), then the contour 14 would nevertheless at least partially engage the post 45. Similarly, if the structure depicted in FIG. 9A did not include a physical wall 60, then the contour 14 would nevertheless at least partially engage the jamb 43. In this aspect, the presence of a slot 15 in the contour 14 does not require a wall 60 or fence.

The mat 10 depicted in FIG. 11 may include a contour 14 that at least partially engages with part of the jamb 43 (which may include a door molding 48) and part of the wall 60. The mat 10, as shown, may cover only a portion of the threshold 40. In this embodiment, when the mat 10 is in place, the engagement between the contour 14 and part of the jamb 43, the door molding 48, and/or the wall 60 may help resist unintended movement of the mat 10. In this example, the mat 10 includes a combination of shapes. The mat 10 shown in FIG. 12 may cover a portion of the floor near an opening 100 while not covering the threshold 40 or engaging with the jamb 43.

In use, the mat 10 in one embodiment, shown in FIG. 1A, may be described as substantially H-shaped, positioned lengthwise in the opening 100. The contours 14 located at the opposing ends give the mat 10 its letter-H shape. The mat 10 may be sized in length to nearly match the size of the opening 100. In commerce, the mat 10 may be produced in several lengths according to the size of several standard doorway types. To place the mat 10 along the opening 100, with the door 50 open, a user may start by positioning the contour 14 on one end of the mat 10 against one of the side posts of jambs; for example, against the hinge-side jamb 44 shown in FIG. 1A. This position places the top of the letter-H shape against the hinge-side jamb 44. With one contour 14 in place, the other end of the mat 10 may be lowered and the opposing contour 14 may be positioned against the latch-side jamb 42. Once in place across the threshold 40, the mat 10 in this embodiment may extend to cover part of the nearby floor 76 and the distant floor 78. The mat 10 may have a thickness sized to allow operation of the door 50 in the opening 100. Protrusions extending downwardly from part of the lower surface of the mat 10 may engage the floors 76, 78 and/or floor coverings, and once engaged may help resist movement of the mat 10. A door 50 may also help resist movement of the mat 10. The engagement between the contours 14 and the side jambs 42, 44 may also help resist movement of the mat 10.

In another embodiment, the mat 10 shown in FIG. 3 may be described as about half the size of the mat 10 shown in FIG. 1A. The contours 14, as shown in FIG. 3, engage about half the jambs 42, 44. The mat 10 may be sized in length to nearly match the size of the opening 100. To place the mat 10 along the opening 100, a user may position one end at a time, as described above. Alternatively, a user may maneuver the mat 10 from the near side of the opening 100 toward the threshold 40 until the contours 14 engage with the jambs 42, 44 and then lower the mat 10 onto part of the nearby floor 76. Once in place across the threshold 40, the mat 10 in this embodiment may extend to cover part of the nearby floor 76.

In another embodiment, the mat 10 shown in FIGS. 6, 7, 8, and 11 may be described as engaging a single side jamb 43. The mat 10 may be sized according to the desired use, with or without regard to the size of the opening. To place the mat 10, a user may position the contour 14 against the jamb 43 and then lower the mat 10 onto part of the threshold 40. Once in place, the mat 10 in this embodiment may extend to cover part of the nearby floor.

In another embodiment, the mat 10 shown in FIGS. 9A and 10A may be described as engaging a side jamb 43 or post 45, respectively, and also engaging a wall 60. The mat 10 may be sized according to the desired use, with or without regard to the size of the opening. To place the mat 10, a user may start by positioning the contour 14 against the jamb 43 or post 45. In this embodiment, as shown in FIGS. 9B and 10B, the slot 15 may be somewhat narrower in width than the contour 14. Accordingly, placement of this mat 10 may require the user to manipulate or bend the mat 10 until the contour 14 partially surrounds the jamb 43 or post 45, and the slot 15 engages the wall 60. In this positioning process, the contour 14 may snap in place around the jamb 43 or post 45. The user may then lower the mat 10 onto part of the nearby floor.

Conclusion

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

What is claimed is:

1. A mat for selectively covering a threshold of an opening and part of a floor near said threshold, said opening partly defined by a substantially vertical first side jamb and a substantially opposing second side jamb, each of said first and second side jambs having a substantially planar face, wherein said mat comprises:

a substantially planar, substantially rectangular mat body with upper and lower surfaces, said mat body having a first edge sized and shaped to at least partially engage said first side jamb and a second edge sized and shaped to at least partially engage said second side jamb;

at least one substantially rigid lateral protrusion extending outwardly from said first edge, wherein said at least one substantially rigid lateral protrusion extending outwardly from said first edge at least partially engages said first side jamb when said mat is positioned adjacent said threshold; and at least one substantially rigid lateral protrusion extending outwardly from said second edge, wherein said at least one substantially rigid lateral protrusion extending outwardly from said second edge at least partially engages said second side jamb when said mat is positioned adjacent said threshold.

2. The mat of claim 1, wherein:

said mat body is sized in length according to said threshold such that said mat covers substantially all of said threshold; and said at least one substantially rigid lateral protrusion extending outwardly from said first edge and said at least one substantially rigid lateral protrusion extending outwardly from said second edge each comprise at least one substantially triangular-shaped lateral protrusion.

3. The mat of claim 2, wherein said first side jamb includes a first non-planar feature, and wherein said first edge defines a first cutout sized and shaped to at least partially match said first non-planar feature;

said mat is adapted to snap into place between said first jamb and said second jamb; and said at least one substantially rigid lateral protrusion extending outwardly from said first edge and the at least one substantially rigid lateral protrusion extending outwardly from said second edge each comprise a series of substantially triangular-shaped lateral protrusions, wherein each of said series of substantially triangular-shaped lateral protrusions are configured to be substantially parallel to said floor adjacent said threshold when said mat is positioned adjacent to said threshold.

4. The mat of claim 3, wherein said second side jamb includes a second non-planar feature, and wherein said second edge defines a second cutout sized and shaped to at least partially match said second non-planar feature, and wherein said mat body with said first and second cutouts is substantially H-shaped.

5. The mat of claim 4, wherein said opening is partly defined by a wall adjacent said opening, and wherein at least one of said first and second cutouts at least partially engages said wall.

6. The mat of claim 1, wherein said opening is partly defined by a wall adjacent said opening, and wherein at least one of said first and second edges at least partially engages said wall.

7. The mat of claim 1, further comprising one or more protrusions extending downwardly from at least a portion of said lower surface for engagement with said floor.

8. The mat of claim 7, wherein said protrusions have a shape selected from the group consisting of a substantially planar adhesive layer, an array of pegs, an array of projections arranged at an angle with respect to each nearest projection, a series of ridges and grooves disposed alternately to form a corrugation, and a rim disposed near an edge of said mat body.

9. The mat of claim 1, wherein said mat body includes a material selected from the group consisting of substantially transparent, substantially opaque, imbued with one or more colors, and imbued with a graphic image at least partially visible through said upper surface.

10. The mat of claim 1, wherein a first portion of said mat body has a first thickness and a second portion of said mat body near at least a portion of its edge has a second thickness at least partially thinner than said first thickness, the difference between said thicknesses defining a taper.

11. A mat for selectively covering a threshold of an opening and part of a floor near said threshold, said opening partly defined by a substantially vertical first side jamb and a substantially opposing second side jamb, wherein said mat comprises:

a substantially planar mat body with upper and lower surfaces, wherein said mat body defines a perimeter edge having a first contour sized and shaped to at least partially engage said first side jamb and a second contour sized and shaped to at least partially engage said second side jamb; and one or more protrusions extending downwardly from at least a portion of said lower surface for engagement with said floor;

at least one substantially rigid lateral protrusion extending outwardly from said first contour, wherein said at least one substantially rigid lateral protrusion extending outwardly from said first contour at least partially engages said first side jamb when said mat is positioned adjacent said threshold; and at least one substantially rigid lateral protrusion extending outwardly from said second contour, wherein said at least one substantially rigid lateral protrusion extending outwardly from said second contour at least partially engages said second side jamb when said mat is positioned adjacent said threshold, wherein said mat is adapted to snap into place between said first side jamb and said second side jamb.

12. The mat of claim 11, wherein said mat body is sized in length according to said threshold such that said mat covers substantially all of said threshold.

13. The mat of claim 11, wherein said mat body is sized in width such that said mat covers part of said floor on only one side of said threshold.

14. The mat of claim 11, wherein said opening is partly defined by a wall adjacent said opening, and wherein at least one of said first and second contours at least partially engages said wall.

15. The mat of claim 11, wherein said downwardly extending protrusions have a shape selected from the group consisting of a substantially planar adhesive layer, an array of pegs, an array of projections arranged at an angle with respect to each nearest projection, a series of ridges and grooves disposed alternately to form a corrugation, and a rim disposed near said perimeter edge.

16. A mat for selectively covering a threshold of an opening and part of a floor adjacent said threshold, said opening partly defined by a substantially vertical first side jamb and a substantially opposing second side jamb, each of said first and second side jambs having a substantially planar face, wherein said mat comprises:

a substantially planar, substantially rectangular mat body with upper and lower surfaces, wherein:

said mat body:

is sized in length according to said threshold such that said mat covers substantially all of said threshold;

comprises:

a first edge sized and shaped to at least partially engage said first side jamb to resist movement of said mat body;

a second edge sized and shaped to at least partially engage said second side jamb to resist movement of said mat body, wherein said first edge and said second edge each comprise at least one substantially rigid lateral protrusion extending outwardly to resist the movement of said mat body relative to said threshold;

at least a portion of said upper surface comprises a rough surface;

said first side jamb includes a first non-planar feature, and wherein said first edge defines a first cutout sized and shaped to at least partially match a contour of said first non-planar feature;

said second side jamb includes a second non-planar feature, and wherein said second edge defines a second cutout sized and shaped to at least partially match said second non-planar feature;

said opening is partly defined by a wall adjacent said opening; and at least one of said first and second cutouts for at least partially engaging said wall, wherein said lower surface comprises a plurality protrusions extending downwardly from at least a portion of said lower surface for engagement with said floor, wherein said plurality of protrusions are selected from a group consisting of:

an array of pegs;

an array of projections arranged at an angle with respect to each nearest projection; and a series of ridges and grooves disposed alternatively to form a corrugation.

17. The mat of claim 16, wherein said plurality of protrusions extending downwardly from at least the portion of said lower surface for engagement with said floor comprise an array of projections arranged at an angle with respect to each nearest projection.

18. The mat of claim 16, wherein said plurality of protrusions extending downwardly from at least the portion of said lower surface for engagement with said floor comprise a series of ridges and grooves disposed alternatively to form a corrugation.

19. The mat of claim 16, wherein said mat body comprises:

(A) a first substantially elastic region comprising the first edge; and (B) a second substantially elastic region comprising the second edge.

20. The mat of claim 19, wherein said first substantially elastic region and said second substantially elastic region each have a thickness sufficiently thin such that the first and second edge are flexible.

* * * * *